US010629342B2

(12) United States Patent
Ohya et al.

(10) Patent No.: US 10,629,342 B2
(45) Date of Patent: Apr. 21, 2020

(54) RARE EARTH BONDED MAGNET

(71) Applicant: MINEBEA MITSUMI INC., Kitasaku-gun, Nagano (JP)

(72) Inventors: Shiho Ohya, Fukuroi (JP); Yu Okawara, Shizuka (JP); Susumu Teraoka, Fukuroi (JP); Toshinori Suzuki, Shuchi-gun (JP); Akihiro Yamane, Fukuroi (JP)

(73) Assignee: MINEBEA MITSUMI INC., Nagano (JP)

( * ) Notice: Subject to any disclaimer, the term of this patent is extended or adjusted under 35 U.S.C. 154(b) by 365 days.

(21) Appl. No.: 15/414,461

(22) Filed: Jan. 24, 2017

(65) Prior Publication Data

US 2017/0213625 A1 Jul. 27, 2017

(30) Foreign Application Priority Data

Jan. 25, 2016 (JP) ..... 2016-012279
Dec. 28, 2016 (JP) ..... 2016-255495

(51) Int. Cl.

| | |
|---|---|
| ***H01F 1/053*** | (2006.01) |
| ***H01F 1/057*** | (2006.01) |
| ***B22F 1/00*** | (2006.01) |
| ***C22C 1/05*** | (2006.01) |
| ***C22C 38/00*** | (2006.01) |

(Continued)

(52) U.S. Cl.

CPC ..... *H01F 1/053* (2013.01); *B22F 1/0003* (2013.01); *B22F 1/0059* (2013.01); *B22F 1/0074* (2013.01); *C22C 1/05* (2013.01); *C22C 38/002* (2013.01); *C22C 38/005* (2013.01); *H01F 1/0578* (2013.01); *H01F 1/08* (2013.01); *B22F 2003/023* (2013.01); *B22F 2301/355* (2013.01)

(58) Field of Classification Search

CPC ..... H01F 1/0533; H01F 1/0578; B22F 1/0059
See application file for complete search history.

(56) References Cited

U.S. PATENT DOCUMENTS 4,342,852 A * 8/1982 Takeda ..... C08G 8/04 525/422
6,063,876 A * 5/2000 Hayakawa ..... C08G 59/063 257/E23.119

(Continued)

FOREIGN PATENT DOCUMENTS

CN 104051117 A 9/2014
JP 2013-253122 A 12/2013

(Continued)

OTHER PUBLICATIONS

Translation for JP 2015-153778, Aug. 24, 2015.*

(Continued)

*Primary Examiner* — C Melissa Koslow
(74) *Attorney, Agent, or Firm* — Pearne & Gordon LLP

(57) ABSTRACT

A rare earth bonded magnet comprises a rare earth-iron-based magnetic powder and a thermosetting resin composition. The thermosetting resin composition is obtained by blending a dicyclopentadiene type epoxy resin as a base resin and dicyandiamide as a curing agent. The dicyclopentadiene type epoxy resin includes a predetermined structure wherein an average value of a repeating unit n is 1 to 3.

2 Claims, 3 Drawing Sheets

(51) Int. Cl.
*H01F 1/08* (2006.01)
*B22F 3/02* (2006.01)

(56) References Cited

U.S. PATENT DOCUMENTS

| | | | | |
|---|---|---|---|---|
| 6,515,237 | B2 * | 2/2003 | Kikuchi | H05K 3/4069 174/202 |
| 6,645,630 | B1 * | 11/2003 | Nakamura | C08G 59/245 428/413 |
| 2014/0265716 | A1 | 9/2014 | Kim et al. | |
| 2015/0017450 | A1 | 1/2015 | Oka et al. | |
| 2016/0314887 | A1 | 10/2016 | Miyazaki et al. | |
| 2018/0040405 | A1 | 2/2018 | Miyazaki et al. | |

FOREIGN PATENT DOCUMENTS

| | | | |
|---|---|---|---|
| JP | 2015-008232 | A | 1/2015 |
| JP | 2015-115529 | A | 6/2015 |
| JP | 2015-153778 | * | 8/2015 |
| JP | 2015-153778 | A | 8/2015 |
| WO | 2013-111697 | A1 | 8/2013 |
| WO | WO 2015-146764 | * | 10/2015 |

OTHER PUBLICATIONS

Translation for WO 2015-146764, Oct. 1, 2015.*
Chinese Office Action dated Jun. 19, 2018 for corresponding to Chinese Application No. 201710037713.9 and English translation.
Chinese Office Action dated Mar. 13, 2019 for corresponding to Chinese Application No. 201710037713.9 and English translation.
"Chemical product manual of Jiangsu Province (industry of fine chemicals part)", Science and Technology Information Center of Petrochemical Industry Department of Jiangsu Province, Jun. 1986 and English translation.
Decision to Grant a Patent dated Jul. 27, 2018 for corresponding Japanese Application No. 2016-255495 and English translation.
Chinese Office Action dated Sep. 29, 2019 for corresponding to Chinese Application No. 201710037713.9 and English translation.

* cited by examiner

RARE EARTH BONDED MAGNET

CROSS REFERENCE TO RELATED APPLICATIONS

This application claims the benefit of Japanese Patent Application No. 2016-011279, filed Jan. 25, 2016, and Japanese Patent Application No. 2016-255495, filed Dec. 28, 2016, which are hereby incorporated by reference in their entirety.

BACKGROUND

Technical Field

The present disclosure relates to a rare earth bonded magnet.

Background Art

A rare earth magnet has excellent magnetic properties and therefore in recent years is extensively used in rotary equipment such as motors, general home electric appliances, audio equipment, medical equipment, industrial instruments, and the like. Especially, a rare earth bonded magnet which is formed of a rare earth magnetic powder combined with a resin binder is highly flexible in terms of formation and so assists in reducing size and enhance performance in the usages described above.

The rare earth bonded magnet is further noted to have been used in vehicles (this usage is referred to as "automotive application"). A ferrite permanent magnet has been used for the common permanent magnet in automotive applications since the ferrite permanent magnets have high heat resistance and the like. Such a ferrite permanent magnet, however, exhibits a relatively low spontaneous magnetization or magnetic force, and therefore has a drawback of needing to be large in volume in order to produce a necessary magnetic flux. Consequently, in response to requests for increased output and reduced size, the rare earth magnet, which has a high spontaneous magnetization even with a small volume, is increasingly used year on year in place of the ferrite permanent magnet.

Since automobiles are exposed to various environmental conditions, permanent magnets for automotive application are required to exhibit adequate magnetic properties under a wide range of temperatures, that is to say, must not be demagnetized substantially due to temperature fluctuations while having physical heat resistance. The physical heat resistance referred to herein refers to the heat resistance relating to mechanical strengths. Generally, the rare earth permanent magnet is substantially demagnetized at high temperatures, thus presenting a heat demagnetization problem. Under such a circumstance, attempts have been made to develop rare earth magnets with magnetic properties that do not decrease a great deal at a high temperature and a method for producing the rare earth magnets (see, e.g., Japanese Patent Laid-Open No. 2015-8232).

The present disclosure was achieved under such circumstances and is intended to provide a rare earth bonded magnet with a demagnetization property with a lower demagnetization rate in response to temperature fluctuations and high physical heat resistance.

SUMMARY

The rare earth bonded magnet in accordance with one aspect of the present disclosure comprises a rare earth-iron-based magnetic powder and a thermosetting resin composition, the thermosetting resin composition being obtained by blending, a dicyclopentadiene type epoxy resin as a base resin and dicyandiamide as a curing agent, the dicyclopentadiene type epoxy resin including a structure represented by the following chemical formula (1) where an average value of a repeating unit n is 1 to 3.

(1)

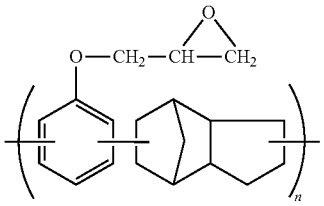

The rare earth bonded magnet in accordance with one aspect of the present disclosure comprises 70% or more of the dicyclopentadiene type epoxy resins blended in the thermosetting resin composition being the dicyclopentadiene type epoxy resin including the structure in which the repeating unit n is 1.

The rare earth bonded magnet in accordance with one aspect of the present disclosure comprises 1 to 3 mass % of the thermosetting resin composition.

The rare earth bonded magnet in accordance with one aspect of the present disclosure comprises the magnetic powder comprising neodymium, iron and boron as main components.

The present disclosure accordingly enables the rare earth bonded magnet with a demagnetization property with a lower demagnetization rate in response to temperature fluctuations and high physical heat resistance.

DETAILED DESCRIPTION

Figure 1:
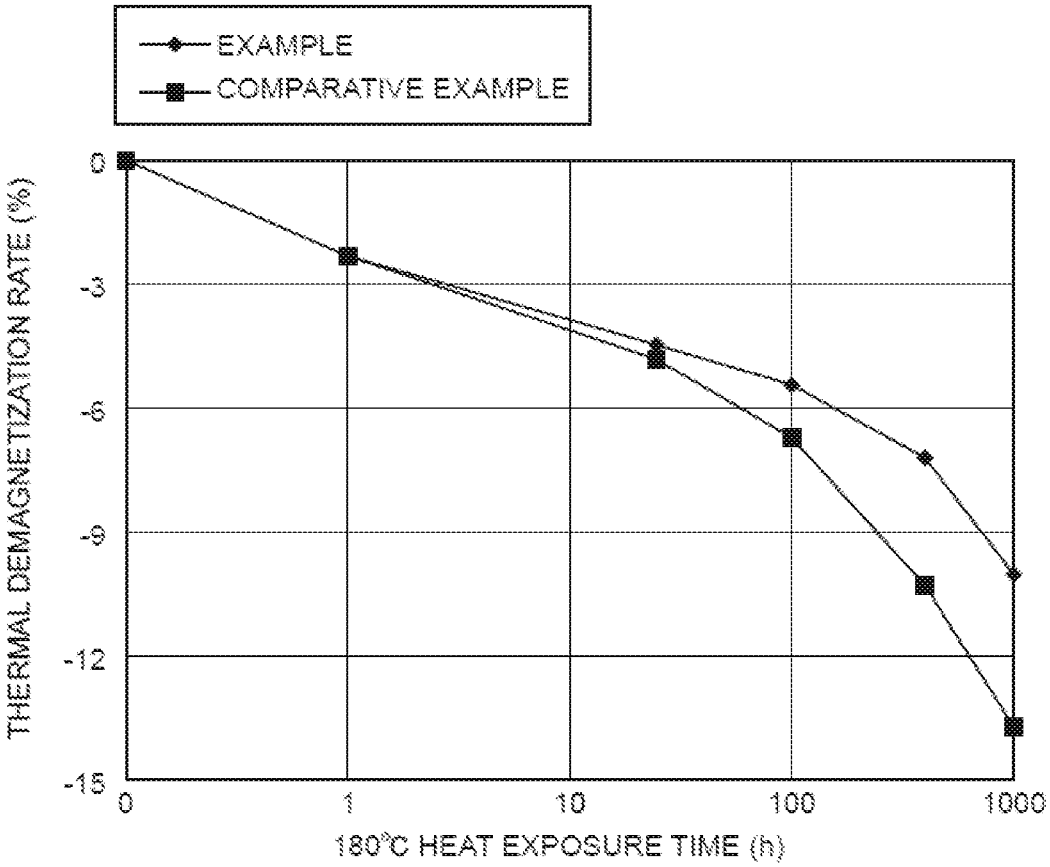
FIG. 1 is a drawing illustrating the thermal demagnetization rate of the rare earth bonded magnets of Example and Comparative Example.

Hereinafter, embodiments of the rare earth bonded magnet in accordance with the present disclosure will be described in detail with reference to the drawings. Note that the embodiments are not intended to limit the present disclosure.

Embodiments

The present inventors investigated the cause of thermal demagnetization occurrence in rare earth bonded magnets and found that the rare earth bonded magnet with a significant dimensional change in response to temperature changes, i.e., a high thermal expansion coefficient, also has a significant thermal demagnetization. This is presumably because voids are caused during temperature elevation in the inner part of a rare earth bond magnet with a high thermal expansion coefficient, and the magnetic powder in contact with the air present in the voids is oxidized and deteriorated.

Accordingly, the use of a thermosetting composition with a low thermal expansion coefficient as a binder for bonding magnetic powders may be expected to reduce the thermal demagnetization rate. However, the present inventors found that the use of a thermosetting resin composition with a low thermal expansion coefficient may fail to achieve a sufficient radial crushing strength for practical use and cause low physical heat resistance. The present inventors thus conducted extensive studies to enable a demagnetization property with a lower demagnetization rate in response to temperature fluctuations and high physical heat resistance and found a thermosetting resin composition which is capable of achieving them.

Specifically, the rare earth bonded magnet in accordance with an embodiment of the present disclosure comprises a rare earth-iron-based magnetic powder and a thermosetting resin composition, the thermosetting resin composition being obtained by blending, a dicyclopentadiene type epoxy resin as a base resin and dicyandiamide as a curing agent, the dicyclopentadiene type epoxy resin including a structure represented by the following chemical formula (1) where an average value of a repeating unit n is 1 to 3.

(1)

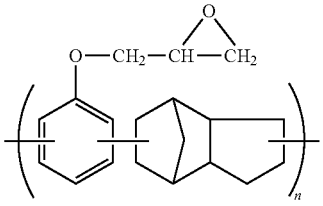

The dicyandiamide is represented by the following chemical formula (2).

(2)

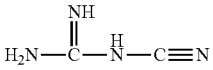

Examples of the dicyclopentadiene type epoxy resin including a structure represented by the following chemical formula (1) where the average value of the repeating unit n is 1 to 3 including those represented by the following formula (3) where a repeating unit m is 0 to 2.

(3)

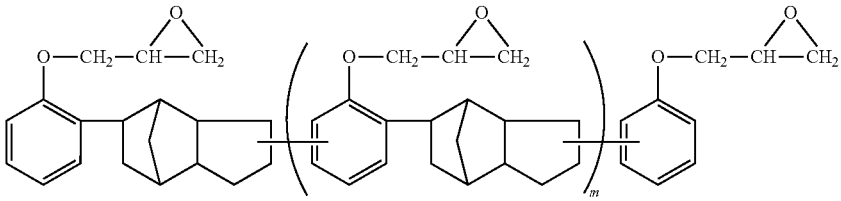

By using the dicyclopentadiene type epoxy resin including a comparatively small molecular weight and having the structure in which the average value of the repeating unit n is 1 to 3 as the base resin of the thermosetting resin composition, the thermal expansion coefficient of the rare earth bonded magnet using the above thermosetting resin composition as a binder can be advantageously decreased.

The use of dicyandiamide as a curing agent along with this base resin further enables the rare earth bonded magnet to have a sufficient radial crushing strength for practical use and high physical heat resistance. The high radial crushing strength rendered by the use of dicyandiamide as a curing agent is conceivably due to the good reactivity to the dicyclopentadiene type epoxy resin, which is ideal to achieve a high radial crushing strength.

The repeating unit n in the structure included in the dicyclopentadiene type epoxy resin to be blended in the thermosetting resin composition has an average value ranging from 1 to 3, preferably from 1 to 2. The dicyclopentadiene type epoxy resin including the structure where the repeating unit n is larger than 1 may also be blended in. Preferably 70% or more of the dicyclopentadiene type epoxy resin blended in the thermosetting resin composition is the dicyclopentadiene type epoxy resin including the structure where the repeating unit n is 1. Most preferably, all of the dicyclopentadiene type epoxy resin blended in the thermosetting resin composition includes the structure where the repeating unit n is 1.

The rare earth-iron-based magnetic powder is not specifically limited but a Nd—Fe—B magnetic powder comprising neodymium (Nd), iron (Fe) and boron (B) as the main components is preferably used. The mass ratio of the magnetic powder to the thermosetting resin composition is preferably about 100:1 to 100:3 (i.e., the rare earth bonded magnet comprises 1 to 3 mass % of the thermosetting resin composition).

The rare earth bonded magnet in accordance with the present embodiment is produced, for example, as follows.

First, the rare earth-iron-based magnetic powder is crushed. The particle size of the rare earth-iron-based magnetic powder herein ranges preferably from 30 μm to 500 μm, further preferably from 50 μm to 250 μm. With a particle size of the magnetic powder of 30 μm or more, the specific surface area of the magnetic powder is reduced, decreasing the probability for the magnetic powder itself to be oxidized. The magnetic powder having a particle size of less than 500 μm is suitable for compression molding a ring magnet with a thickness of less than 1 mm. A narrow particle size distribution of the rare earth magnetic powder is desirable to achieve good moldability for the molding in a later step.

Subsequently, the rare earth-iron-based magnetic powder and a solution of the thermosetting resin composition are kneaded. The solution of thermosetting resin composition refers to a solution wherein the dicyclopentadiene type epoxy resin as the base resin and dicyandiamide as the curing agent are blended in a predetermined mass ratio and dissolved in a solvent. The kneaded product produced by the kneading is called a compound.

The compound is then dried. The drying step volatilizes the solvent contained in the solution of the thermosetting resin composition.

The dried compound is then crushed and classified based on particle sizes of the compound. The particle size range of the compound is desirably, for example, from about 30 to 500 μm when considering the properties of filling a cavity of a mold such as a metallic mold in a step to be followed.

A lubricant is then mixed with the compound. The lubricant facilitates the properties of filling into a cavity of a mold such as a metallic mold and to reduce the friction against the mold under an applied pressure during the molding in a later step.

The compound is then filled into the mold cavity and compression-molded by applying pressure. The pressure to be applied is higher than or equal to the yield point of the thermosetting resin composition and, for example, preferably about 0.1 GPa to 1.5 GPa. The molded product obtained by the compression molding has a volume fraction of the residual voids of preferably 6 vol % or more and 12 vol % or less therein.

Finally, the molded product obtained by the compression molding is heated and thermally set. The thermosetting is carried out in the present embodiment, for example, at a temperature from 150° C. to 190° C. for about 10 minutes to 100 minutes. The thus thermally set product to be magnetized is separately coated for anticorrosion protection. After that, a magnetization is separately carried out to complete the rare earth bonded magnet.

EXAMPLE, COMPARATIVE EXAMPLE

Example and Comparative Example of the present disclosure are described below. Two hollow cylindrical rare earth bonded magnets (denoted as Sample 1-1 and Sample 1-2 obtained under different thermosetting conditions) were produced to be Examples of the present disclosure by the production method described above, using a Nd—Fe—B magnetic powder (chemical formula: $Nd_2Fe_{14}B$) as the magnetic powder, a dicyclopentadiene type epoxy resin (Tg after reacted to the curing agent and set: about 160° C.) as the base resin of the thermosetting resin composition, dicyandiamide as the curing agent and 2-butanone as the solvent. The amount of each ingredient blended was adjusted so that a mass ratio of the magnetic powder to the thermosetting resin composition was 100:2.5. To obtain sample 1-1, the thermosetting step was carried out by heating the molded product from room temperature to 190° C. over 1 hour, and keeping it at 190° C. for 30 minutes. To obtain sample 1-2, the thermosetting step was carried out by directly placing the molded product in the oven preheated to 190° C., and keeping the temperature of the oven at 190° C. for 30 minutes.

A gel permeation chromatography (GPC) analysis revealed that the dicyclopentadiene type epoxy resin used comprises the dicyclopentadiene type epoxy resin wherein the repeating unit n is 1 and the dicyclopentadiene type epoxy resin wherein the repeating unit n is 2 in the chemical formula (1) only includes about 76% and about 24% respectively, with the average repeating unit n being about 1.24.

A hollow cylindrical rare earth bonded magnet (denoted as Sample 2-1) was produced to be the Comparative Example by the production method described above, using a Nd—Fe—B magnetic powder (chemical formula: $Nd_2Fe_{14}B$) as the magnetic powder, a naphthol type epoxy resin represented by the following chemical formula (4) (Tg after reacted to the curing agent and set: 200° C. or higher) as the base resin of the thermosetting resin composition, a phenolic curing agent represented by the following chemical formula (5) as the curing agent and 2-butanone as the solvent. On the other hand, by the production method described above, with the thermosetting step, a hollow cylindrical rare earth bonded magnet (denoted as Sample 2-2) in which an unreacted (uncured) state is remaining was produced. The amount of each ingredient blended was adjusted so that a mass ratio of the magnetic powder to the thermosetting resin composition was 100:2.5. The thermosetting at the time of producing Sample 2-1 was carried out at 190° C. for only 30 minutes.

(4)

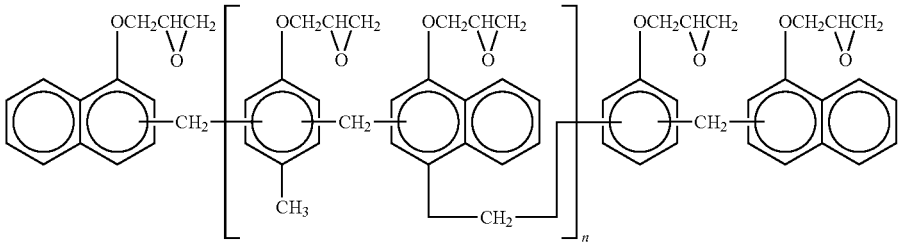

(5)

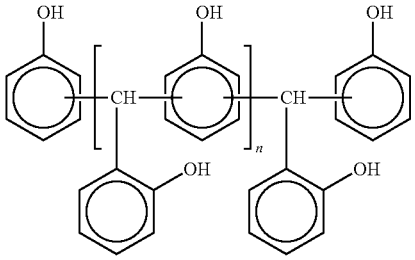

The rare earth bonded magnets produced in the Example and the Comparative Example were then exposed to heat at 180° C. for 1000 hours during which magnetic fluxes of the magnetic fields generated from the rare earth bonded magnets were measured. FIG. 1 is a drawing illustrating the thermal demagnetization rate (decreasing rate of the magnetic flux) of the rare earth bonded magnets of the Example (Sample 1-1) and the Comparative Example (Sample 2-1). Note that the vertical axis shows the thermal demagnetization rate and the horizontal axis shows the heat exposure time in logarithmic form. As illustrated in FIG. 1, it was verified that the demagnetization rate of the rare earth bonded magnet of the Example has lower absolute values than those of the demagnetization rate of the rare earth bonded magnet of the Comparative Example and the differences between both thermal demagnetization rates become greater as the heat exposure time is prolonged.

Described below are the results of verification experiments on the rare earth bonded magnets of the Example (Sample 1-1) and the Comparative Example (Sample 2-1) by thermomechanical analysis (TMA). Thermomechanical analysis is a technique for measuring the deformation of an object to be tested in response to temperatures (dimensional change rate in the present experiment), while the temperature of the object is changed in accordance with a specific program.

Figure 2:
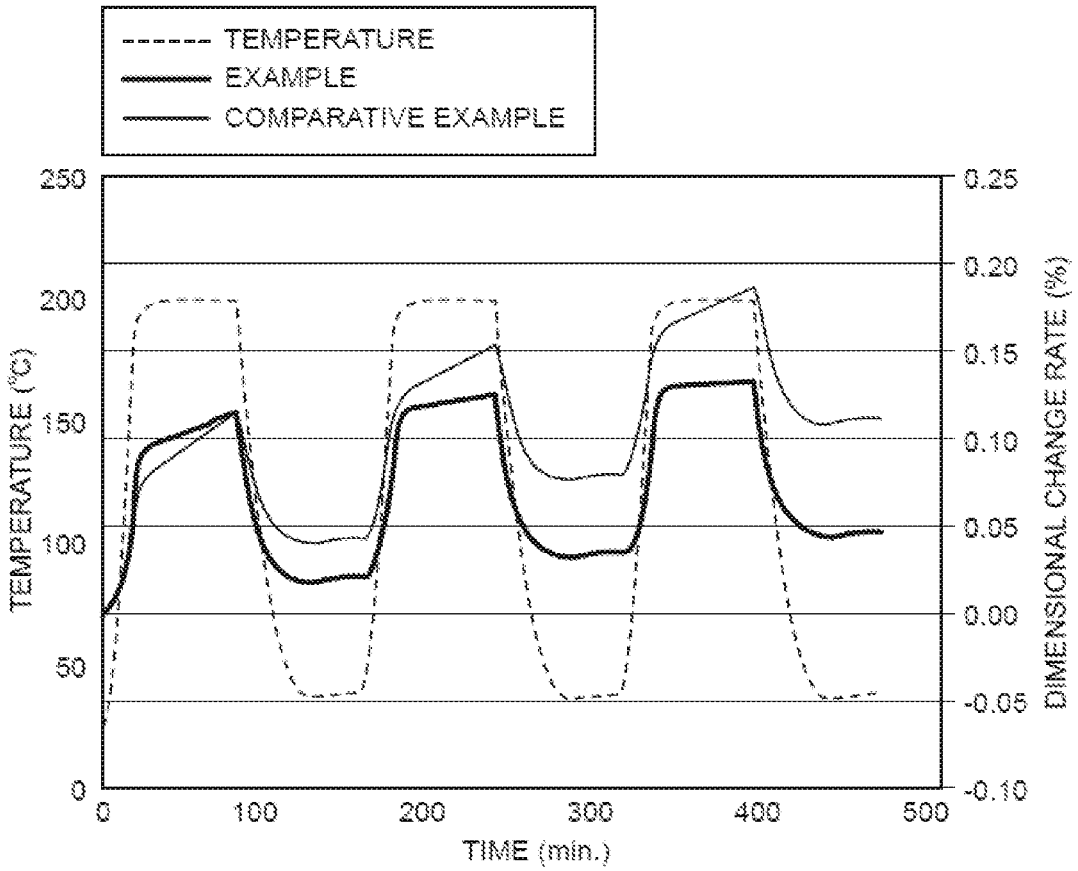
FIG. 2 is a drawing illustrating the dimensional change rate at the time that the rare earth bonded magnets of the Example and the Comparative Example were thermomechanically analyzed.

FIG. 2 is a drawing illustrating the dimensional change rate when the rare earth bonded magnets of the Example and the Comparative Example were thermomechanically analyzed. Note that the left vertical axis shows the temperature of the rare earth bonded magnets, the right vertical axis shows the dimensional change rate of the rare earth bonded magnets and the horizontal axis shows the time. The dotted line shows the temperature changes and the thick solid line and thin solid line show the changes of dimensional change rates of the Example and the Comparative Example, respectively.

As illustrated in FIG. 2, the rare earth bonded magnet of the Comparative Example accumulates the hysteresis of temperature changes as the test time is prolonged, tending to increase the dimensional change rate of the rare earth bonded magnet. Conversely, the rare earth bonded magnet of the Example was confirmed to have the comparatively small dimensional change rate. This result conceivably suggests the low thermal expansion coefficient and high physical heat resistance of the rare earth bonded magnet of the Example.

The radial crushing strength of the rare earth bonded magnets of the Example and the Comparative Example was measured. The radial crushing strength herein is the strength against a load applied in a radial direction of the rare earth bonded magnets formed into a hollow cylinder and is specifically measured in conformity with the method described in JIS Z 2507. The radial crushing strength of the rare earth bonded magnet of the Example (Sample 1-1) was found to be 72 MPa and the radial crushing strength of the rare earth bonded magnet of the Comparative Example (Sample 2-1) was found to be 63 MPa. The rare earth bonded magnet of the Example was thus confirmed to have a higher radial crushing strength than the bonded magnet of the Comparative Example.

Figure 3:
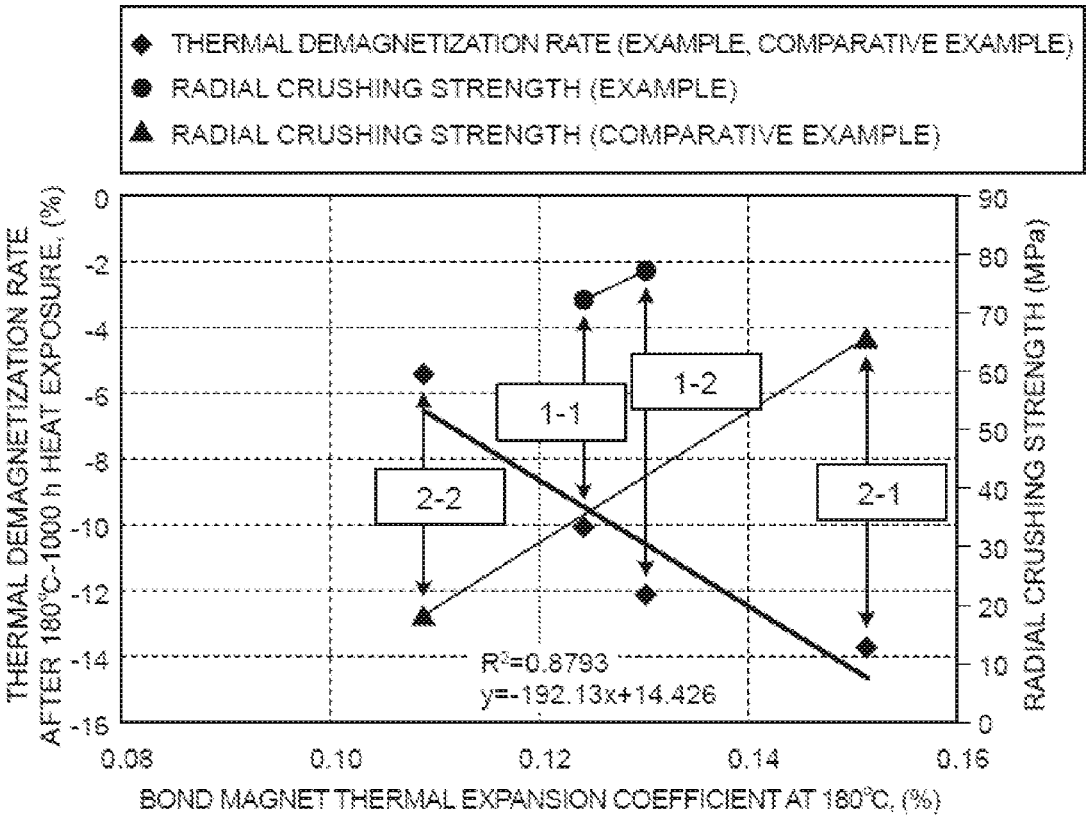
FIG. 3 is a drawing illustrating the relationship of thermal expansion coefficient to thermal demagnetization rate and radial crushing strength of the rare earth bonded magnets of the Example and the Comparative Example.

FIG. 3 is a drawing illustrating the relationship of thermal expansion coefficient to thermal demagnetization rate and radial crushing strength of the rare earth bonded magnets of the Example and the Comparative Example. Note that the left vertical axis shows the thermal demagnetization rate, the right vertical axis shows the radial crushing strength and the horizontal axis shows the thermal expansion coefficient of the rare earth bonded magnets at 180° C. determined from the TMA results. Table 1 shows specific numerical values of the dimensional change rate (maximum value), radial crushing strength and thermal demagnetization rate measured above for the Example (Sample 1-1) and the Comparative Example (Sample 2-1).

TABLE 1

| | Binder | Dimensional change rate when heated, [%] | Radial crushing strength [MPa] | Thermal demagnetization rate after 180° C. 1000 h heat exposure, [%] |
|---|---|---|---|---|
| Example | Base resin: Dicyclopentadiene type epoxy resin Curing agent: Dicyandiamide | 0.125 | 72 | 10.0 |
| Comparative Example | Base resin: Naphthol type epoxy resin Curing agent: Phenolic curing agent | 0.151 | 63 | 13.7 |

As illustrated in FIG. 3, it was validated that the thermal expansion coefficient and thermal demagnetization rate are in an approximately proportional relationship regardless of the different thermosetting resin compositions used in the rare earth bonded magnet of the Example and the rare earth bonded magnet of the Comparative Example, wherein the lower the thermal expansion coefficient, the lower the absolute value of thermal demagnetization rate. The radial crushing strength and the thermal demagnetization rate were also validated to be in a trade-off relationship in both the rare earth bonded magnet of the Example and the rare earth bonded magnet of the Comparative Example. The rare earth bonded magnet of the Example was validated to be more capable of enhancing the radial crushing strength while suppressing the thermal demagnetization rate than the rare earth bonded magnet of the Comparative Example. It is suitable for the radial crushing strength to be about 50 MPa or more for practical use.

The Tg of the naphthol type epoxy resin used as the base resin in the thermosetting resin composition of the Comparative Example is, as described above, 200° C. or higher, which is higher than the Tg (160° C.) of the dicyclopentadiene type epoxy resin used as the base resin in the thermosetting resin composition of the Example. However, as is evident in the above experiment results, the rare earth bonded magnet of the Example has a demagnetization property with a lower demagnetization rate in response to temperature fluctuations and higher physical heat resistance. It is thus notable not only to simply use a base resin with a high Tg for enabling a demagnetization property with a lower demagnetization rate in response to temperature fluctuations and high physical heat resistance, but also to use a base resin with a considered molecular weight like the dicyclopentadiene type epoxy resin used in the Example together with a curing agent suitable therefore.

Note that the above embodiments are not intended to limit the present disclosure. The present disclosure encompasses those component elements composed of a suitable combination of each component element described above. Further effects and modifications are also easily conceivable by those skilled in the art. Therefore, a wide variety of aspects of the present disclosure are not limited to the above embodiments and various modifications are possible.

What is claimed is:

1. A rare-earth bonded magnet comprising:

A rare-earth-iron-based magnetic powder comprising neodymium, iron and boron as main components; and a thermosetting resin, the thermosetting resin composition being obtained by blending a dicyclopentadiene type epoxy resin as a base resin and dicyandiamide as a curing agent, the dicyclopentadiene type epoxy resin including a structure represented by the following formula (1) where the average value of a repeating unit n is 1 to 3, (1)

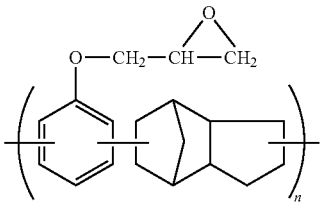

wherein 70% or more of the dicyclopentadiene type epoxy resin blended in the thermosetting resin is the dicyclopentadiene type epoxy resin of the structure where the respecting unit n is 1, wherein thermal demagnetization rate after 1000 h heat exposure at 180° C. is 10% to about 12%, the rare earth bonded magnet comprises 1 to 3 mass % of the thermosetting resin, and a Tg (glass transition temperature) of the dicyclopentadiene type epoxy resin after reacted to the curing agent is about 160° C.

2. The rare earth bonded magnet according to claim 1, wherein radial crushing strength is 50 MPa or higher.

* * * * *